US005839781A

United States Patent [19]

Knape

[11] Patent Number: 5,839,781

[45] Date of Patent: Nov. 24, 1998

[54] LAWN CHAIR ROCKER BASE SYSTEM

[76] Inventor: Ronnie D. Knape, Rte. 4, Box 533, Alvin, Tex. 77511

[21] Appl. No.: 985,072

[22] Filed: Dec. 4, 1997

[51] Int. Cl.[6] ..... A47C 3/029; A47C 13/10

[52] U.S. Cl. ..... 297/258.1; 297/133; 297/272.1

[58] Field of Search ..... 297/258.1, 259.1, 297/260.1, 272.1, 133

[56] References Cited

U.S. PATENT DOCUMENTS

| | | | |
|---|---|---|---|
| 244,104 | 7/1881 | Andrews | 297/133 |
| 255,104 | 3/1882 | Dryfoos et al. | 297/133 |
| 257,937 | 5/1882 | Gerwig | 297/133 X |
| 264,917 | 9/1882 | Andrews | 297/133 |
| 271,907 | 2/1883 | Olmsted | 297/133 |
| 304,435 | 9/1884 | Malick | 297/133 |
| 524,151 | 8/1894 | Walker | 297/272.1 X |
| 1,367,390 | 2/1921 | Hinson | 297/272.1 X |
| 1,535,298 | 4/1925 | Drabinsky | 297/133 |
| 1,682,685 | 8/1928 | Rodery | 297/272.1 |
| 2,662,580 | 12/1953 | Gottfried | 297/133 |
| 2,662,581 | 12/1953 | Gottfried | 297/133 |
| 3,114,572 | 12/1963 | Hopkins | 297/133 X |
| 3,306,660 | 2/1967 | Williams | 297/272.1 X |
| 3,471,196 | 10/1969 | Gottfried | 297/272.1 X |
| 4,079,991 | 3/1978 | Harris | 297/272.1 X |
| 5,560,675 | 10/1996 | Altheimer et al. | 297/258.1 X |
| 5,660,431 | 8/1997 | Leach | 297/133 |

FOREIGN PATENT DOCUMENTS

| | | | |
|---|---|---|---|
| 2202430 | 9/1988 | United Kingdom | 297/272.1 |

*Primary Examiner*—Jose V. Chen
*Assistant Examiner*—Rodney B. White
*Attorney, Agent, or Firm*—Joseph N. Breaux

[57] ABSTRACT

A lawn chair rocker base system for converting a lawn chair having four legs that support a seat into a rocking chair. The lawn chair rocker base system includes a rocker base assembly and a chair locking structure. The rocker base assembly includes two rocker members that are spaced apart and secured together by two rigid spacer bars, each rocker member including a curved rocker rail and two chair foot receiving structures, each chair foot receiving structure including a planar chair foot receiving surface and a chair foot insertion opening formed through two rigid plates oriented at right angles to each other and at a right angle to the planar foot receiving surface. The chair locking structure includes four locking channel members supported in a spaced rectangular configuration by four structural spacer bars, each of the four locking channel members having an L-shaped cross-section, one of the four locking channel members being positioned at one of the four corners of the spaced rectangular configuration, the interior of each of the four locking channel members being oriented away from the center of the rectangular configuration, the chair locking structure being sized such that each of the four locking channel members is simultaneously positionable adjacent to one of the chair foot receiving structures.

16 Claims, 2 Drawing Sheets

LAWN CHAIR ROCKER BASE SYSTEM

TECHNICAL FIELD

The present invention relates to rocking chairs and more particularly to a lawn chair rocker base system for converting a lawn chair having four legs into a rocking chair, the lawn chair rocker base system including a rocker base assembly and a chair locking structure; the rocker base assembly including two rocker members that are spaced apart and secured together by two rigid spacer bars, each rocker member including a curved rocker rail and two chair foot receiving structures, each chair foot receiving structure including a planar chair foot receiving surface and a chair foot insertion opening formed through two rigid plates oriented at right angles to each other and at a right angle to the planar foot receiving surface; the chair locking structure including four locking channel members supported in a spaced rectangular configuration by four structural spacer bars, each of the four locking channel members having an L-shaped cross-section, one of the four locking channel members being positioned at one of the four corners of the spaced rectangular configuration, the interior of each of the four locking channel members being oriented away from the center of the rectangular configuration, the chair locking structure being sized such that each of the four locking channel members is simultaneously positionable adjacent to one of the chair foot receiving structures.

BACKGROUND ART

It is often desirable to convert a lawn chair of the type having four legs that support a seat into a rocking chair. It would of course also be desirable to have a lawn chair rocker base system that included a molded plastic rocker assembly that was easily securable to the four legs of the lawn chair with a molded plastic locking structure.

GENERAL SUMMARY DISCUSSION OF INVENTION

It is thus an object of the invention to provide a lawn chair rocker base system for converting a lawn chair having four legs that support a seat into a rocking chair.

It is a further object of the invention to provide a lawn chair rocker base system that includes a molded plastic rocker assembly that is easily securable to the four legs of the lawn chair with a molded plastic locking structure to convert the lawn chair into a rocker.

It is a still further object of the invention to provide a lawn chair rocker base system that includes a rocker base assembly and a chair locking structure; the rocker base assembly including two rocker members that are spaced apart and secured together by two rigid spacer bars, each rocker member including a curved rocker rail and two chair foot receiving structures, each chair foot receiving structure including a planar chair foot receiving surface and a chair foot insertion opening formed through two rigid plates oriented at right angles to each other and at a right angle to the planar foot receiving surface; the chair locking structure including four locking channel members supported in a spaced rectangular configuration by four structural spacer bars, each of the four locking channel members having an L-shaped cross-section, one of the four locking channel members being positioned at one of the four corners of the spaced rectangular configuration, the interior of each of the four locking channel members being oriented away from the center of the rectangular configuration, the chair locking structure being sized such that each of the four locking channel members is simultaneously positionable adjacent to one of the chair foot receiving structures.

It is a still further object of the invention to provide a lawn chair rocker base system that accomplishes some or all of the above objects in combination.

Accordingly, a lawn chair rocker base system for converting a lawn chair having four legs that support a seat into a rocking chair is provided. The lawn chair rocker base system includes a rocker base assembly and a chair locking structure; the rocker base assembly including two rocker members that are spaced apart and secured together by two rigid spacer bars, each rocker member including a curved rocker rail and two chair foot receiving structures, each chair foot receiving structure including a planar chair foot receiving surface and a chair foot insertion opening formed through two rigid plates oriented at right angles to each other and at a right angle to the planar foot receiving surface; the chair locking structure including four locking channel members supported in a spaced rectangular configuration by four structural spacer bars, each of the four locking channel members having an L-shaped cross-section, one of the four locking channel members being positioned at one of the four corners of the spaced rectangular configuration, the interior of each of the four locking channel members being oriented away from the center of the rectangular configuration, the chair locking structure being sized such that each of the four locking channel members is simultaneously positionable adjacent to one of the chair foot receiving structures.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
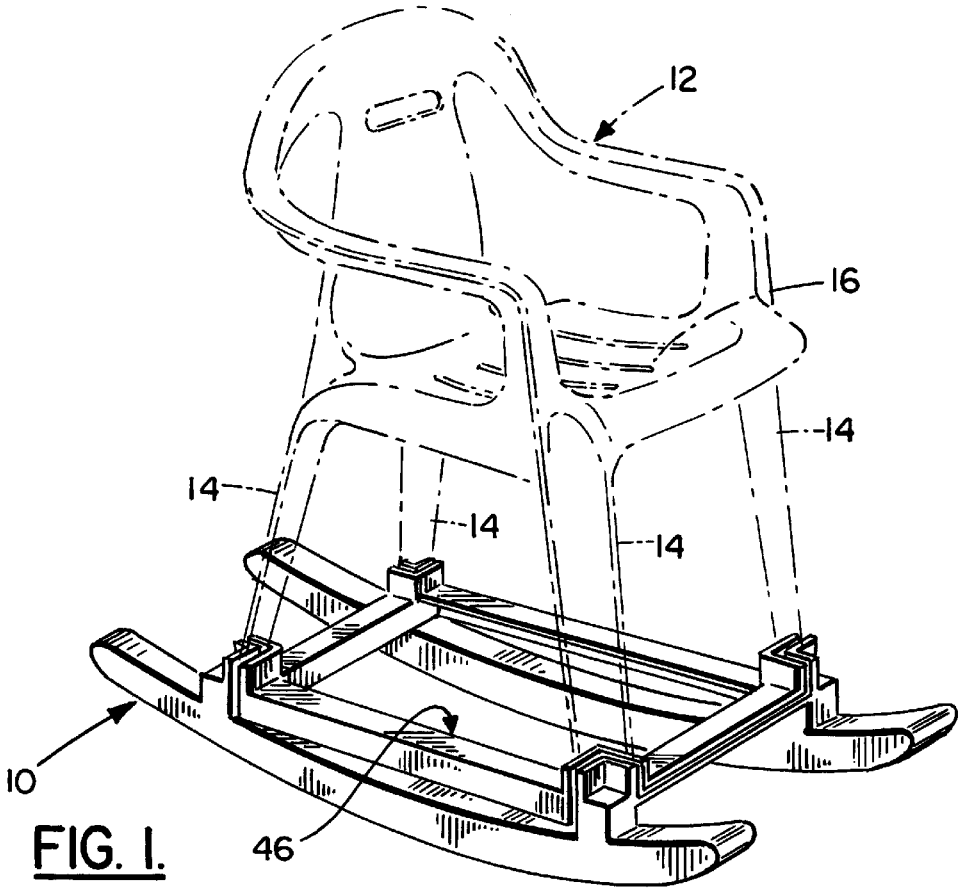
FIG. 1 is a perspective view of an exemplary embodiment of the rocker base assembly and chair locking structure of the lawn chair rocker base system of the present invention and a representative lawn chair of the type with which the lawn chair rocker base system of the present invention is used.
Figure 5:
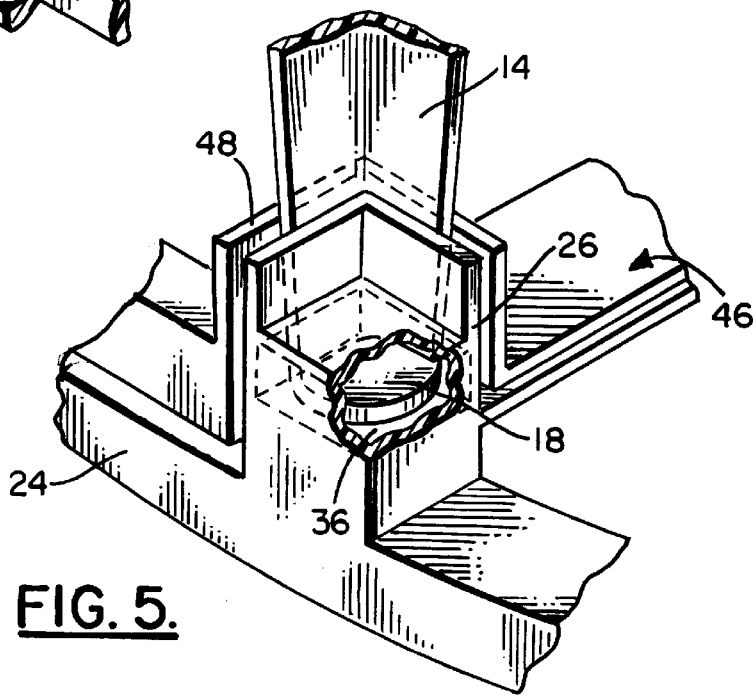
FIG. 5 is a detail perspective view of one of the chair foot receiving structures, one chair foot of the representative lawn chair of FIG. 1 positioned onto the planar chair foot receiving surface of the chair foot receiving structure through the chair foot insertion opening, and one of the four locking channel members seated against a portion of the chair leg above the chair foot and maintaining the chair foot on the chair foot receiving surface.

FIG. 1 shows exemplary embodiments of the rocker base assembly, generally designated 10, and the chair locking structure, generally designated 46, of the lawn chair rocker base system of the present invention and a representative lawn chair, generally designated 12 of the type with which the lawn chair rocker base system of the present invention is used. Lawn chair 12 includes four legs 14 attached to and supporting a seat 16. Each leg 14 has a chair foot 18 (FIG. 5) having a flat surface for positioning onto the ground or other flat surface.

Figure 2:
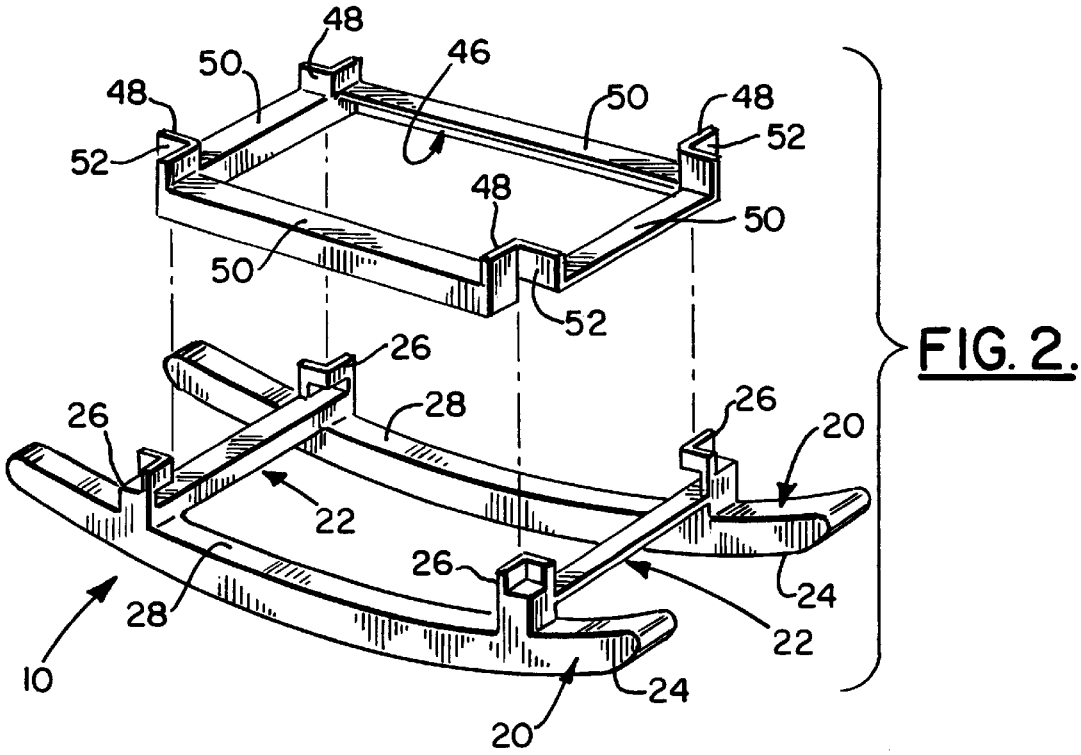
FIG. 2 is an exploded perspective view of the exemplary rocker base assembly and chair locking structure of FIG. 1 showing the rocker base assembly including two rocker members that are spaced apart and secured together by two spacer bars, each rocker member including a curved rocker rail and two chair foot receiving structures; and the chair locking structure including four locking channel members supported in a spaced rectangular configuration by four structural spacer bars, each of the four locking channel members having an L-shaped cross-section.
Figure 3:
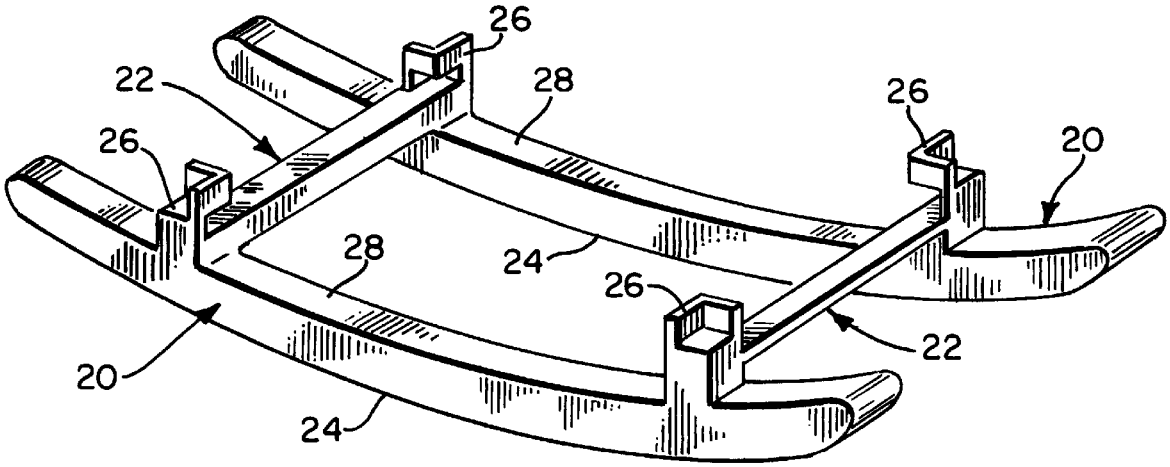
FIG. 3 is a perspective view of the rocker base assembly of FIG. 1 in isolation showing the two rocker members, the two spacer bars, each rocker member including a curved rocker rail and two chair foot receiving structures.
Figure 4:
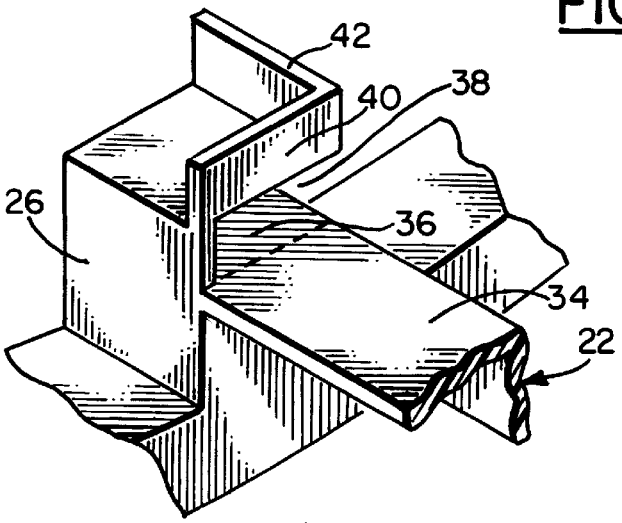
FIG. 4 is a detail perspective view of one of the chair foot receiving structures, one of the rocker rails and one of the spacer bars, each chair foot receiving structure including a planar chair foot receiving surface and a chair foot insertion opening formed through two plates oriented at right angles to each other and at a right angle to the planar foot receiving surface.

With reference to FIG. 2, rocker base assembly 10 is of molded plastic construction and includes two rocker members, generally designated 20 that are spaced apart and secured together by two spacer bars, generally designated 22. With reference to FIG. 3, each rocker member 20 includes a curved rocker rail 24 and two chair foot receiving structures 26. Each chair foot receiving structure 26 extends outwardly from the upper surface 28 of one of the curved rocker rails 24 and is formed with an end of one of the spacer bars 22. With reference to FIG. 4, each spacer bar 22 has a planar spacer bar surface 34 that is coplanar with a rectangular shaped, planar chair foot receiving surface 36 of chair foot receiving structure 26. Planar chair foot receiving surface 36 is accessible through a chair foot insertion opening 38 that is formed through two plates 40,42 of chair foot receiving structure 26 that are oriented at right angles to each other and at a right angle to planar foot receiving surface 36.

With reference back to FIG. 2, chair locking structure 46 is of molded plastic construction and includes four locking channel members 48 that are supported in a spaced rectangular configuration by four structural spacer bars 50. Each of the four locking channel members 48 has an L-shaped cross-section and is positioned at one of the four corners of the spaced rectangular configuration such that an interior portion 52 (only three shown) of each of the four locking channel members 48 is oriented away from the center of the rectangular configuration. Chair locking structure 46 is sized such that each of the four locking channel members 48 is simultaneously positionable adjacent to one of the four chair foot receiving structures 26 by inserting chair locking structure 46 vertically downward, with reference now to FIG. 5, after each of the four chair feet 18 of chair legs 14 is positioned onto a planar chair foot receiving surface 36 of one of the four chair foot receiving structures 26 through a respective chair foot insertion opening 38 (FIG. 4). When chair locking structure 46 is fully inserted, each of the chair locking channel members 48 is seated against a portion of a chair leg 14 above a chair foot 18 such that each of the chair feet 18 is maintained on its respective chair foot receiving surface 36 sufficiently to allow a person seated on chair 12 (FIG. 1) to rock back and forth on curved rocker rails 24 (FIG. 1).

It can be seen from the preceding description that a lawn chair rocker base system for converting a lawn chair having four legs that support a seat into a rocking chair has been provided that includes a molded plastic rocker assembly that is easily securable to the four legs of the lawn chair with a molded plastic locking structure to convert the lawn chair into a rocker; and that includes a rocker base assembly and a chair locking structure; the rocker base assembly including two rocker members that are spaced apart and secured together by two rigid spacer bars, each rocker member including a curved rocker rail and two chair foot receiving structures, each chair foot receiving structure including a planar chair foot receiving surface and a chair foot insertion opening formed through two rigid plates oriented at right angles to each other and at a right angle to the planar foot receiving surface; the chair locking structure including four locking channel members supported in a spaced rectangular configuration by four structural spacer bars, each of the four locking channel members having an L-shaped cross-section, one of the four locking channel members being positioned at one of the four corners of the spaced rectangular configuration, the interior of each of the four locking channel members being oriented away from the center of the rectangular configuration, the chair locking structure being sized such that each of the four locking channel members is simultaneously positionable adjacent to one of the chair foot receiving structures.

It is noted that the embodiment of the lawn chair rocker base system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lawn chair rocker base system for converting a lawn chair having four legs that support a seat into a rocking chair, the lawn chair rocker base system comprising:

a rocker base assembly; and a chair locking structure;

said rocker base assembly including two rocker members that are spaced apart and secured together by two rigid spacer bars, each rocker member including a curved rocker rail and two chair foot receiving structures, each chair foot receiving structure including a planar chair foot receiving surface and a chair foot insertion opening;

said chair locking structure including four locking channel members supported in a spaced rectangular configuration having four corners by four structural spacer bars, each of said four locking channel members having an L-shaped cross-section, an interior of each of said four locking channel members being oriented away from a center of said rectangular configuration, said chair locking structure being sized such that each of said four locking channel members is simultaneously positionable adjacent to one of said chair foot receiving structures.

2. The lawn chair rocker base system of claim 1, wherein:

said rocker base assembly is of molded plastic construction.

3. The lawn chair rocker base system of claim 2, wherein: and said chair locking structure is of molded plastic construction.

4. The lawn chair rocker base system of claim 3 wherein:

one of said four locking channel members is positioned at each of the four corners of said spaced rectangular configuration.

5. The lawn chair rocker base system of claim 4 wherein:

said chair foot insertion opening is formed through two rigid plates oriented at right angles to each other and at a right angle to said planar foot receiving surface.

6. The lawn chair rocker base system of claim 3 wherein:

said chair foot insertion opening is formed through two rigid plates oriented at right angles to each other and at a right angle to said planar foot receiving surface.

7. The lawn chair rocker base system of claim 2 wherein:

one of said four locking channel members is positioned at each of the four corners of said spaced rectangular configuration.

8. The lawn chair rocker base system of claim 7 wherein:

said chair foot insertion opening is formed through two rigid plates oriented at right angles to each other and at a right angle to said planar foot receiving surface.

9. The lawn chair rocker base system of claim 2 wherein:

said chair foot insertion opening is formed through two rigid plates oriented at right angles to each other and at a right angle to said planar foot receiving surface.

10. The lawn chair rocker base system of claim 1, wherein: and said chair locking structure is of molded plastic construction.

11. The lawn chair rocker base system of claim 10 wherein:

one of said four locking channel members is positioned at each of the four corners of said spaced rectangular configuration.

12. The lawn chair rocker base system of claim 10 wherein:

said chair foot insertion opening is formed through two rigid plates oriented at right angles to each other and at a right angle to said planar foot receiving surface.

13. The lawn chair rocker base system of claim 11 wherein:

said chair foot insertion opening is formed through two rigid plates oriented at right angles to each other and at a right angle to said planar foot receiving surface.

14. The lawn chair rocker base system of claim 1 wherein:

one of said four locking channel members is positioned at each of the four corners of said spaced rectangular configuration.

15. The lawn chair rocker base system of claim 14 wherein:

said chair foot insertion opening is formed through two rigid plates oriented at right angles to each other and at a right angle to said planar foot receiving surface.

16. The lawn chair rocker base system of claim 1 wherein:

said chair foot insertion opening is formed through two rigid plates oriented at right angles to each other and at a right angle to said planar foot receiving surface.

* * * * *